United States Patent [19]

Selmin

[11] 4,322,578

[45] Mar. 30, 1982

[54] METHOD AND DEVICES FOR THE OMNIDIRECTIONAL RADIATION OF SOUND WAVES

[75] Inventor: Paolo Selmin, Castel Maggiore, Italy

[73] Assignee: Society AP Selmin SAS of Massimo Coltelli & Co., Bologna, Italy

[21] Appl. No.: 940,309

[22] Filed: Sep. 6, 1978

[30] Foreign Application Priority Data

Sep. 6, 1977 [IT] Italy ..... 27274 A/77

[51] Int. Cl.[3] ..... H04R 1/02

[52] U.S. Cl. ..... 179/1 E; 181/175; 181/199

[58] Field of Search ..... 179/1 E, 180, 1 D; 181/175, 184, 176, 191, 155, 192, 194, 199, 152

[56] References Cited

U.S. PATENT DOCUMENTS

| | | | |
|---|---|---|---|
| 2,805,728 | 9/1957 | Manley | 181/184 |
| 3,400,217 | 9/1968 | Kraut | 179/1 E |
| 3,467,218 | 9/1969 | Fusimoto et al. | 181/175 |
| 3,862,366 | 1/1975 | Huszty et al. | 179/1 E |
| 3,909,530 | 9/1975 | Gosswiller | 179/1 E |
| 3,912,866 | 10/1975 | Fox | 179/1 E |
| 3,964,571 | 6/1976 | Snell | 181/199 |
| 3,980,829 | 9/1976 | Beveridge | 179/1 E |
| 3,985,957 | 10/1976 | Torn | 179/1 E |
| 4,189,627 | 2/1980 | Flanagan | 181/175 |
| 4,200,170 | 4/1980 | Williams, Jr. | 181/199 |

*Primary Examiner*—Gerald L. Brigance

*Attorney, Agent, or Firm*—Hubbell, Cohen, Stiefel & Gross

[57] ABSTRACT

The present invention pertains to a method and apparatus for achieving a uniform omnidirectional radiation of sound waves, particularly at high frequencies, and for increasing selectivity and separation at frequencies in the medium to high frequency wave band The apparatus consists of a series of reflector-diffractor barriers which are frequency selective. Each barrier is operative to transmit sound waves of a frequency greater than a selected value and to reflect and omnidirectionally radiate sound waves of a frequency less than the value.

26 Claims, 6 Drawing Figures

FIG. 4.
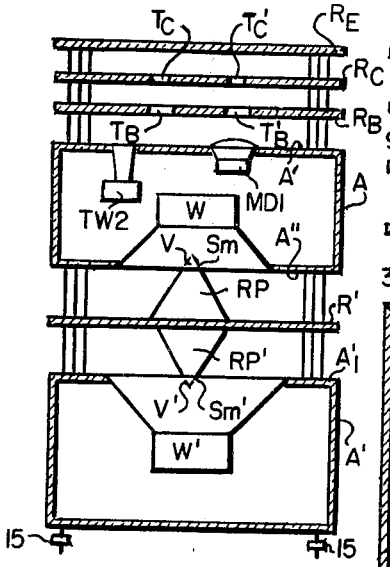
FIG. 5.
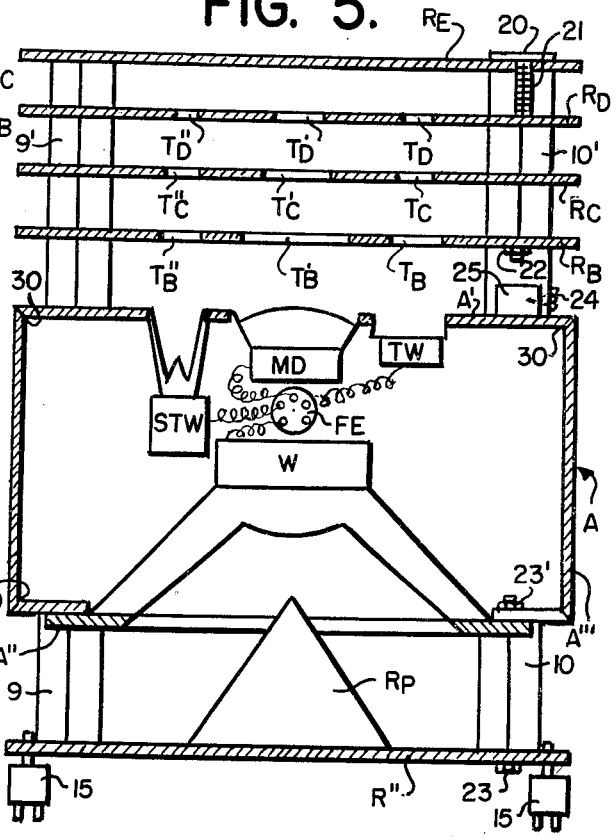
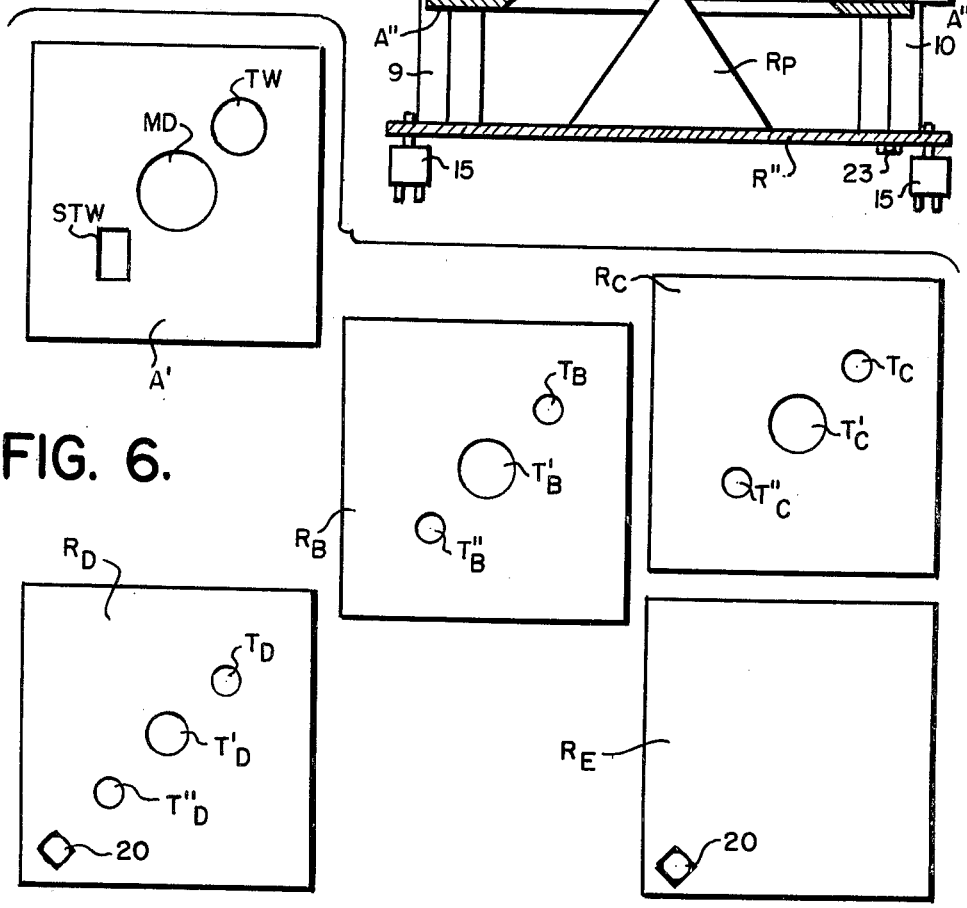
FIG. 6.

METHOD AND DEVICES FOR THE OMNIDIRECTIONAL RADIATION OF SOUND WAVES

BACKGROUND ART

One of the major drawbacks of conventional high fidelity sound-diffusers, which consist of several frontally oriented loudspeakers, is that high frequencies are radiated in a directional way, i.e. with a reduced angle of emission. This is because sound radiation remains spherical, and therefore omnidirectional, only as long as the radiated wave-length is much greater than the diameter of the sound source, which is generally only true for low frequencies. For example, the wave length of a typical low frequency sound wave is 3.44 m, which is significantly greater than a typical low frequency loudspeaker diameter of 30 cm. Consequently, low frequency sound exhibits a wide emission angle.

However, for increasingly higher frequency sound waves, the wave length decreases, and eventually becomes smaller than the diameter of the source. At this point, nearly the entire wave energy is radiated directionally along the speaker axis. Consequently, the source emits plane waves exhibiting a narrow emission angle.

Consequently, conventional diffusers of this kind, though provided with high-quality parts, have many drawbacks. For example, the response of high frequencies varies considerably throughout the room, and may be too high along the axis giving rise to a squeaky and tiring sound, and considerably attenuated in lateral positions, e.g. 30 degrees off axis. Consequently, the timbres of instruments tend to be distorted, since it is well known that timbres are distinguished by the harmonics of the highest frequency. Another drawback is that the positioning of the diffuser in a common domestic room becomes extremely difficult. Thus, if a highly reflective wall or other object is in the axial path of the diffuser, chain reflections and undesirable echoes occur. If, on the other hand, an absorbing surface is in the axial path of the diffuser, high frequencies are completely absorbed, and the resulting sound tends to be too deep. Another drawback occurs in stereophonic listening, where, in addition to the difficulty of accurately positioning two diffusers, the listening area in which the two stereophonic messages can be heard in their full range of frequencies is rather limited. Out of this narrow area, resulting from the superpositioning of two narrow angles of high frequency radiation, the timbre range of the stereophonic messages is distorted, in that certain positions exhibit an exaggerated stressing of the high-pitched tones of one channel and a damping of the tones of the other channel. Another drawback results from the nature of high fidelity sound reproduction. Thus, reproducing sound in high fidelity means, as far as possible, recreating the atmosphere of the concert hall, where only a small part of the sound reaches the listener directly, the majority being reflected sound. This fact explains and confirms psychoacoustic research which indicates that the human ear tolerates very high levels of reflected sound pressure, and finds lower sound levels unpleasant when sound hits the ear directly.

DISCLOSURE OF THE INVENTION

One object of this invention is to provide a method for radiating acoustic waves, free of the drawbacks of conventional methods, especially those mentioned above, and which results in a truly uniform omnidirectional radiation. Another object of the invention is to provide a system which, by a proper choice of dimensions and the use of means completely extraneous to the conventional technology, provides an increased selectivity in the omnidirectional radiation of high frequencies, and increased separation of frequencies in the medium-high frequency range. A further object of this invention is the provision of simple, effective and reliable devices for implementing the method of the invention.

The method of the present invention for obtaining uniform radiation of acoustic waves in the frequency band from 20 to 28,000 Hz as emitted by conventional speakers, e.g. woofer, mid-range and/or tweeter, and particularly of those at high frequencies, and for increasing selectivity and separation of medium to high frequency waves, is characterized by the fact that:

(i) the acoustic waves in the lower part of the acoustic band, for instance those emitted by a woofer, undergo omnidirectional reflection only;

(ii) a very small part (15% average) of waves having frequencies immediately above the upper limit of the aforementioned lower band, particularly waves emitted, for instance, by a mid-range and/or a tweeter, also undergo only omnidirectional reflection; and (iii) the remainder of the aforementioned acoustic waves having frequencies above the upper limit of the woofer, i.e. those emitted by a mid-range and/or a tweeter, undergo a series of diffractions and reflections, the diffractions occurring as the waves pass through successively smaller transparent zones in a series of reflectors. In one preferred embodiment of the invention, the sound sources emitting frequencies above the upper limit of the woofer are arranged on a surface to emit sound in a direction orthogonal to the surface, towards a reflection-diffraction system.

The preferred reflection-diffraction system comprises a set of reflectors having surfaces parallel to each other and to the surface on which the sound sources are arranged. Of the n reflectors, $n-1$ have zones transparent to predetermined bands of the aforementioned sound waves, the zones being dimensioned to act as punctiform sources of spheric sound waves. The nth reflector is without a transparent zone.

It is recommended to construct the reflection-diffraction system with a set of superimposed panels of highly waterproof reflecting material. The transparent zones are preferably defined by holes in the panels in line with the axis of the sound sources, or lying within the emission cone of these sources, the diameters of the zones being equal to preselected wave lengths corresponding to a particular frequency in the incident sound waves. According to the invention, the distances among panels and the diameters of the holes decrease as the distance from the sound sources increases.

In an alternative preferred embodiment, the sound waves in the lowest frequency band, i.e. those emitted by a woofer, undergo omnidirectional reflection via a pyramid-shaped reflection system having its axis aligned with the axis of the woofer, and having its apex penetrating the cone of the woofer. Preferably, the woofer emits waves in a direction opposite to that of the higher frequency sound sources. For example, the medium to high frequency sources may be arranged on one wall of a housing, with the low frequency sources arranged on the opposite wall. Generally, the pyramid-shaped reflector and the panels comprising the reflector-diffraction system, as well as the housing for the sound sources, are made of polymers, or copolymers of acrylic monomers, particularly of alkylic, or of compositions mainly based on the above-mentioned acrylic homocopolymers.

The various features and advantages of the invention will be more clearly understood from the following detailed description and annexed drawings of the preferred forms thereof.

BRIEF DESCRIPTION OF THE DRAWINGS

In the drawings:

FIG. 4 is a vertical section of a still further embodiment in accordance with the present invention;

FIG. 5 is a vertical section of yet another embodiment in accordance with the present invention; and FIG. 6 is a top plan view of the reflectors and upper surface of the housing of the embodiment illustrated in FIG. 5.

BEST MODE FOR CARRYING OUT THE INVENTION

To simplify the explanation of the principles of this invention, the medium to high frequency section is treated separately from the low frequency section.

Medium/High Frequency Section

Figure 1:
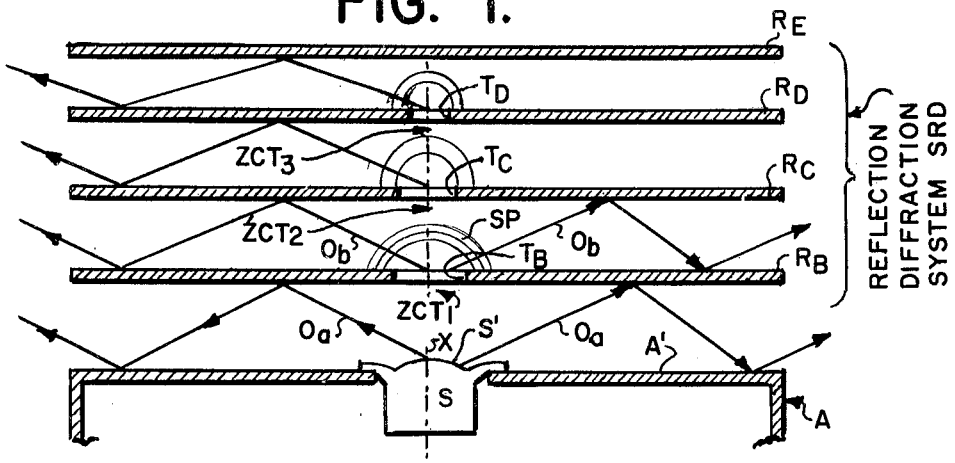
FIG. 1 is a partial vertical section illustrating one embodiment of a device in accordance with the present invention.

In FIG. 1, A is a housing having an upper surface A', in the center of which is a source S of medium to high-frequency sound waves. S may comprise, for example, a tweeter having a cupola S', which is fed, as by an electric filter, with signals having a frequency of 4000 to 20,000 Hz, and therefore emits sound waves ranging from 4000 to 20,000 Hz. According to the invention, a reflection-diffraction system SRD is placed over the cupola S'. The reflection-diffraction system SRD comprises a plurality of reflectors R, of which n−1 reflectors, i.e. the reflectors from R to $R_{n-1}$, have on a part of their respective surfaces, one or more concentrated zones ZCT which are transparent to sound waves emitted by the source S. The surface of the nth reflector, i.e. the reflector $R_n$, does not have a transparent zone.

As used herein, the term "reflector" comprises any means of suitable shape, dimensions and material such that one surface thereof is impervious to and substantially completely reflects incident waves, except for losses due to friction. As used herein, the term "concentrated transparent zones" means small parts of the above-mentioned reflectors from $R_1$ to $R_{n-1}$, where sound waves are transmitted and not reflected.

In FIG. 1, the reflection-diffraction system SRD according to the invention is made up of a set of 4 reflectors (n=4) $R_B$, $R_C$, $R_D$ and $R_E$, the first three of which (n−1=3), that is to say $R_B$, $R_C$ and $R_D$, have concentrated transparent zones, $ZCT_1$, $ZCT_2$ and $ZCT_3$, while the last reflector $R_E$ is totally reflecting, i.e. has no zones of transparency. According to the invention, the above-mentioned concentrated transparent zones $ZCT_1$, $ZCT_2$ and $ZCT_3$ are arranged along the axis X of source S and comprise circular holes, $T_B$, $T_C$ and $T_D$ respectively, having diameters corresponding to the wave length of at least one of the frequencies of the incident waves from the source S. With this arrangement, the result is the following:

(a) A smaller part of the sound waves emitted by S and designated in FIG. 1 by the reference Oa is directly reflected by $R_B$ and spread in all directions. For instance, if in FIG. 1 S emits sound in the wave band from 4 to 20 KHz, and the hole $T_B$ of the first reflector $R_B$ has a diameter of 4.3 cm., equal to a wave length $\lambda=4.3$ and therefore to a frequency of 8000 Hz, the sound waves having frequencies from 4000 to 8000 Hz will be substantially reflected by $R_B$ and ultimately pass out of the cavity between A' and $R_B$, which is open laterally.

(b) In the zone $ZCT_1$ the portion of the wave having a frequency of 8000 Hz, as well as those portions having a frequency near 8000 Hz, give rise to diffractions, and the center of the hole $ZCT_1$ becomes a punctiform source SP of a spheric sound wave having the same frequency as the incident wave. This latter new wave undergoes reflections between the reflectors $R_B$ and $R_C$ and is ultimately propagated in all directions towards the outside, as shown by $O_b$, spreading at 360 degrees through the open slit of the cavity between the panels $R_B$ and $R_C$.

(c) Sound waves with a frequency higher than 8000 Hz carry on their way through the first hole $T_B$, reaching the second hole $T_C$ representing the concentrated transparent zone $ZCT_2$. If the diameter of the hole $T_C$ is 3.2 cm., corresponding to a frequency of 10,700 Hz, frequencies from 8000 Hz to about 10,700 Hz are reflected by $R_C$ and spread at 360 degrees by the cavity between the first and second panels $R_B$ and $R_C$ which, as noted, is open on all sides.

(d) The same is true for the transparent zone $ZCT_3$, the hole of which has a diameter equal to 2.5 cm., corresponding to 13,750 Hz. Consequently, $ZCT_3$ becomes a punctiform source and all waves from 13,750 to 20,000 Hz are reflected and omnidirectionally propagated by the open-sided cavity between the reflector-diffractor $R_D$ and the reflector $R_E$ which, being the last of the set, has no transparent zones.

By employing a reflection-diffraction system, arranged, according to the invention, in such a way that the transparent zones of the individual panels are on the axis of emission of the source S, the surprising result occurs that medium and high frequencies are propagated omnidirectionally, and the musical message propagated to the outside, after passing through the reflection-diffraction system, is free from distortion due to intermodulation, owing to the effect of the diffractions occurring in the concentrated transparent zones. Furthermore, the resultant separation of the instruments produces an effect of musical presence and realness which is not likely to occur with conventional diffusers.

Low-Frequency Section

Figure 2:
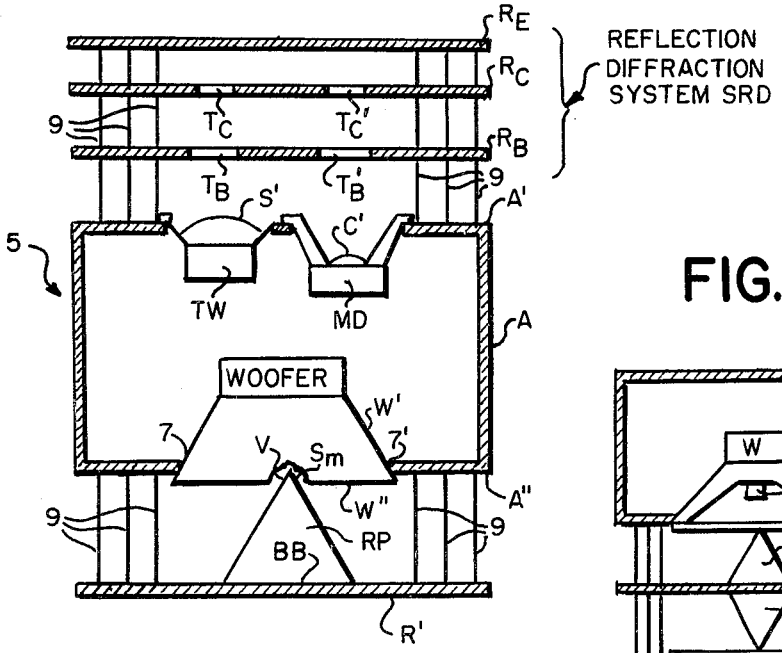
FIG. 2 is a vertical section of an alternative embodiment of a device in accordance with the present invention.

The low-frequency section is illustrated with reference to FIG. 2. FIG. 2 shows a complete device 5 for carrying out the method invented, including both a medium-high frequency section according to the principles described above, and a low-frequency section. The latter is represented by a woofer, whose cone W', having, for example, a diameter equal to 186 mm, opens into the hollow space 7—7' in the lower wall A'' of the housing A. As shown, wall A'' is parallel and opposite to the wall A′ where the sources of medium to high frequency sound are arranged. The waves emitted by the woofer are incident on a pyramid-shaped reflector RP whose axis is aligned with the axis of the woofer. The apex V of the reflector RP extends into the front W″ of the woofer, while the base BB of reflector RP rests on a reflector R′. The reflector R′ is without zones of transparency, and is therefore similar to the reflector $R_E$ in FIG. 1.

The sound waves emitted by the woofer are reflected and omnidirectionally propagated by the reflector RP, passing out of the open-sided cavity between the confronting surfaces of A″ and R′. The standards or uprights 9 which support the box A, the reflector-diffractors $R_B$ and $R_C$, and the last reflector $R_E$, do not take up much room, and thus do not significantly interfere with the desired omnidirectional radiation.

In FIG. 2, the medium to high-frequency section is made up of two sources, i.e. a tweeter TW and a midrange MD, both arranged on the wall A′ of housing A. The reflector-diffractors $R_B$ and $R_C$ have two concentrated zones of transparency each, represented by the holes $T_B$ and $T'_B$ in $R_B$ and by $T_C$ and $T'_C$ in $R_C$. The holes $T_B$ and $T_C$ are aligned with the cupola S′ of the tweeter TW, while the holes $T'_B$ and $T'_C$ are aligned with the axis of the cone C′ of the midrange MD.

In a preferred form of the diffuser illustrated in FIG. 2, the reflectors R′ and $R_E$, the reflector-diffractors $R_B$ and $R_C$, and the walls A′ and A″ of the housing A are all square shaped, being 330 mm on a side. The tweeter TW has a cupola S′ having a diameter of 80 mm, $T_B$ and $T_C$ have diameters of 43 mm and 25 mm, respectively, the midrange MD has a diameter of 90 mm, and the diameters of $T'_B$ and $T'_C$ are 60 mm and 43 mm, respectively. The distance between R′ and A″, which corresponds to the height of the lower uprights 9 and roughly to the height of the pyramid RP, is 90 mm, while the height of the housing A is 200 mm, so the volume of A is 330×330×200 mm. One of the delicate factors according to the invention is the distance among the reflectors. By trial and error, optimal values were found. They are: a distance of 60 mm between A′ and $R_B$, 50 mm between $R_B$ and $R_C$, and 32 mm between $R_C$ and $R_E$.

In FIG. 2, very satisfactory results were also obtained by employing square shaped panels R′, $R_B$, $R_C$ and $R_E$, and square shaped walls A″ and A′, each being 380×380 mm; a cone-shaped woofer having a diameter of 230 mm; a distance between R′ and A″ of 90 mm; a housing A 220 mm high; a trumpet-shaped tweeter about 75 mm high with an opening, in a hole in A′, of 50×100 mm; a hole $T_B$ having a diameter of 32 mm and a hole $T_C$ having a diameter of 20 mm; a midrange MD with cupola having a diameter of 125 mm; and a hole $T'_B$ having a diameter of 90 mm and a hole $T'_C$ having a diameter of 60 mm.

The distances between A′ and $R_B$, between $R_B$ and $R_C$, between $R_C$ and $R_E$ were kept unchanged, i.e. equal to 60 mm, 50 mm and 32 mm respectively. The thickness of the various reflectors and reflector-diffractors is very important too. For example, in the last-mentioned FIG. 2 embodiment, the best results were achieved with the following thicknesses: R′=8 mm; $R_B$ and $R_C$=3 mm and $R_E$=5 mm.

Good results were also obtained with a device consisting of two loudspeakers only, a tweeter with a cupola having a diameter of 80 mm in A′, and a common cone-shaped woofer having a diameter of 186 mm in A″. In the two-speaker embodiment, R′, A″, A′, $R_B$, $R_C$ and $R_E$ are all square shaped, being 300×300 mm; the height of the box A is 180 mm; the distance between R′ and A″ is 90 mm; the pyramid RP has a base BB of 120 mm, and a height from 8 to V of 120 mm as well; and the diameters $T_B$ and $T_C$ are 43 mm and 25 mm, respectively. The distances between A′, $R_B$, $R_C$ and $R_E$ remain unchanged, that is to say 60 mm, 50 mm and 32 mm, the thicknesses of R′ and $R_E$ are 8 mm and 5 mm, respectively, and the thicknesses of $R_B$ and $R_C$ remain at 3 mm.

Figure 3:
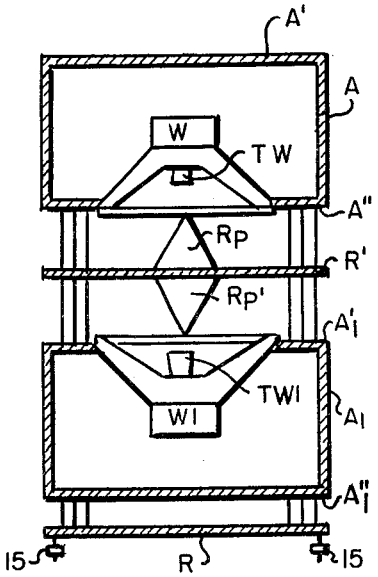
FIG. 3 is a vertical section of a further alternative embodiment in accordance with the present invention.

In FIG. 3, a particularly interesting embodiment is shown. The FIG. 3 embodiment has two housings A and $A_1$, and two woofers W and $W_1$ with coaxial tweeters TW and $TW_1$. As shown, W is disposed in the lower wall A″ of the housing A, and $W_1$ is disposed in the upper wall $A'_1$ of the housing $A_1$. A reflector R′ is equidistant between A″ and $A'_1$, and the bases of two pyramidal reflectors $R_P$ and $R'_P$ are secured to the reflector R′ with their respective vertical axes coaxial with W and $W_1$. The following are suitable dimensions for the diffuser illustrated in FIG. 3, which I refer to as a boxer type diffuser: walls A′, A″, $A'_1$, $A''_1$, the reflector R′ as well as the lower panel R, which preferably rests on four small wheels 15, are all square shaped, being 480×480 mm; the height of housings A and $A_1$ is 250 mm; the diameters of woofers W and $W_1$ are 300 mm; the base as well as the sides of pyramids RP and RP′ is 140 mm; the distance between A″ and R′ and between R′ and $A'_1$ is 110 mm; the distance between $A''_1$ and R is 50 mm; and the thickness of R′ and R is 8 mm.

In FIG. 4, the boxer-type diffuser of FIG. 3 is coupled to a high-frequency section of the type illustrated in the upper part of FIG. 2. Thus, in FIG. 4 the high frequency section comprises a tweeter $TW_2$ and a midrange $MD_1$ in the wall A′ of housing A, and the three reflectors $R_B$, $R_C$ and $R_E$. $R_B$ and $R_C$ have two holes each, $T_B$ and $T'_B$, and $T_C$ and $T'_C$, respectively. The holes $T_B$ and $T_C$ are on the same line as the opening of $TW_2$, and the holes $T'_B$ and $T'_C$ are aligned with the cupola of $MD_1$. In FIG. 4, the dimensions of the housing A differ from those of A′. Likewise, the dimensions of W also differ from those of W′. In a practical form of realization of this diffuser, all the panels are 480×480 mm (as in FIG. 3); the height of housing A is 200 mm and that of A′ is 250 mm; and the diameter of W is 230 mm and that of W′ 354 mm. Since the vertices V and V′ of RP and RP′, respectively, slightly penetrate the cones of W and W′, the distances between R′ and A″ and between R′ and $A'_1$ are 90 mm.

In FIG. 5 a more sophisticated embodiment of the invention, including, for the high-frequency section, a cupola-shaped midrange MD, disposed between a tweeter TW which receives signals coming from the electric filter FE ranging from 4000 to 20,000 Hz, and a tweeter STW, which receives signals from FE ranging from 8000 to 25,000 Hz. The reflector-diffusers $R_B$, $R_C$, $R_D$ have three holes each, $T_B$, $T'_B$ and $T''_B$ in $R_B$; $T_C$, $T'_C$ and $T''_C$ in $R_C$, and so on. The holes $T_B$, $T_C$ and $T_C$ are aligned with the cupola of TW; the holes $T'_B$, $T'_C$ and $T'_D$ are aligned with the cupola of the speaker MD; and the holes $T''_B$, $T''_C$ and $T''_D$ are aligned with the cone of STW. As far as the low-frequency section is concerned, the woofer W receives signals ranging from 20 to 800 Hz from FE and transforms them into sound waves which are directed towards the pyramidal reflector $R_P$. The housing A is supported by the uprights 9 and 10 which are secured to the panel R'', which in turn is supported by four rubber wheels 15. The four upper standards 9' and 10' are secured to the wall A' of the housing A, and support the reflector-diffractors $R_B$, $R_C$ and $R_D$, as well as reflector $R_E$. Preferably, an iron plate 20 secures $R_E$ about a threaded bolt 21 which is secured at its lower end by a screw nut 22. The lower uprights 9 and 10 are preferably held in place by a threaded rod 23 and nut 23'. The upper standard 10' may be coupled, as by a screw 24, with a block 25 made of the same material as the housing A and reflectors $R_B$, $R_C$, $R_D$, $R_E$ and R''.

In a preferred form of the diffuser of FIG. 5, the end of speaker STW seated in A' has a rectangular section 50×100 mm and is aligned with holes $T''_B$, $T''_C$ and $T''_D$ having diameters of 32 mm, 25 mm and 20 mm, respectively. MD has a cupola with a diameter of 125 mm and TW has a cupola with a diameter of 80 mm. MD and TW are respectively aligned with holes having the following diameters: $T'_B$=90 mm, $T'_C$=60 mm, $T'_D$=43 mm; $T_B$=43 mm, $T_C$=32 mm and $T_D$=25 mm. All the reflectors, as well as the housing A, are square with sides of 480 mm. The height of the box A is 250 mm. The woofer W has a diameter of 354 mm, while the pyramidal reflector RP consists of an equilateral triangle with sides of 170 mm. The height of the lower uprights 9 and 10 is 110 mm. The distances among the various reflectors are: Between A' and $R_B$=60 mm; between $R_B$ and $R_C$=50 mm; between $R_C$ and $R_D$=50 mm; and between $R_D$ and $R_E$=32 mm.

The iron plate 20 is square with dimensions of 35×35 mm. The thickness of the housing A and lower panel R'' is 8 mm; the thickness of $R_E$ is 5 mm; and that of the three reflector-diffractors $R_B$, $R_C$, $R_D$ is 3 mm. Preferably, the housing A is made by joining the horizontal panels A' and A'' with the vertical panels A''' by miter joints as shown at 30.

In all the embodiments discussed hereinabove, the most suitable material for the planar reflectors, pyramidal reflectors and reflector-diffractors is a polymeric composition based on acrylic homo-copolymers, especially of methyl-methacrylate, plain or in compound with other monomers such as styrene, vinyl chloride, etc. Also, compositions based on the above-mentioned methacrylic polymers are suitable.

Among the above-mentioned materials, products marketed under the trademarks "PERSPEX" of I.C.I., "VERDRIL" of MONTEDISON, and "PLEXIGLAS" of ROHM & HAAS, have given excellent results. It will be apparent, however, that other similar materials can be used instead. The physical characteristics of a polymer of methylmethacrylate, 500,000 molecular weight, especially of a "PERSPEX" obtained by total polymerization through melting, are, according to ASTM:

Specific gravity: (D792) 1.17–1.20
Tensile strength kg/sq.cm.: (D638) 560–770
Compressive strength kg/sq.cm.: (D695) 770–1330
Impact strength: (D256) 2.1–2.7
Rockwell hardness: (D785) M80–M100
Thermal conductivity: (C177) 0.5–0.7
Dielectric strength: (D149) 450–550
Dielectric constant: (D150) 3–3.5 (100 cycles)
Dielectric factor: (D150) 0.04–0.06 (100 cycles)

It will be apparent that other synthetic crystalline materials, having rigidity (i.e. absence of its own resonances), indexes or reflection and absorption, dielectric constant, etc., comparable to those of polymethylmethacrylate, may also be used. The supporting uprights are preferably comprised of aluminum. A further advantage of the diffusers according to the invention is that they are suited for use with conventional loudspeakers having common transducers and exponential cone, cup or funnel shapes.

The panels are preferably parallelepipeds with square or rectangular surfaces ranging from 10 cm to 100 cm., preferably from 14 cm to 80 cm, and with a thickness of from 1.5 mm to 15 mm, and preferably from 2 mm to 9 mm. The diameters of the holes in the reflector-diffractors range from 5 mm to 125 mm and preferably from 10 mm to 100 mm. The distances among panels, and between the surface of the first housing and the first panel, may vary from 90 mm to 15 mm, and preferably from 80 mm to 20 mm, with the distances between panels decreasing as the distance from the sound sources increases.

The five top plan views of FIG. 6 illustrate the arrangement of the speakers STW, MD and TW on A'', the disposition of holes $T''_B$, $T'_B$ and $T_B$ in $R_B$, of holes $T''_C$, $T'_C$, $T_C$ in $R_C$; of holes $T''_D$, $T'_D$ and $T_D$ in $R_D$; and of the plate 20 on $R_E$. It was surprisingly found that the best results are obtained when the centers of the loudspeakers on A' and the centers of the holes in the panels $R_B$, $R_C$ and $R_D$ are aligned along a diagonal. It was found, furthermore, that it is advantageous and more desirable to arrange the midrange in a position behind at least one tweeter relative to the listener.

The sound performance of the devices described hereinabove, though depending partly on the quality of the components (e.g. loudspeakers) used, have shown: an excellent response in the frequency range from 30 Hz to 20,000 KHz, linear, within 3 db; a very high efficiency (sound pressure) with 1 W input: 92–94 db, 1 m. off.; very low harmonic and intermodulation distortion (remarkably lower than that obtained by placing the loudspeakers in the conventional arrangement); very high dynamics (capability to pass instantaneously from low to very high levels of sound pressure); capacity to reproduce sound without distortions and without listening trouble for very high sound levels (112–115 db at 4 m. off with 100 W applied power.); quick and prompt response to transient impulses due to short rise times; exceptional selectivity and a strong presence for large orchestras and choirs; excellent response to impulsive basses (i.e. percussions) due to the immediate damping of the oscillations of the woofer by the coupled pyramid, which besides radiating sound at 360 degrees, avoids the return of the emitted waves which could give rise to interferences; and very pleasant aesthetics due to the very advanced design and to the materials used for the first time in the field of high fidelity, thereby allowing appropriate placement in any domestic room, with classic or modern furniture. This "optimum optimorum" of features is present in all devices according to the invention with input power in the range from 10 to 250 W.

A further advantage is achieved by using the embodiment, shown in FIGS. 3 and 4, wherein two housings A and $A_1$ are employed, and wherein a speaker is fitted in the bottom of the upper housing and another in the top of the lower housing, the two speakers being in confronting relation. The confronting loudspeakers can be of various types (e.g. woofer, midrange or tweeter or combinations thereof as in FIG. 3). In these embodiments, by virtue of the opposition of the two loudspeakers, the sound waves radiated in phase are compressed among themselves and, owing to this reciprocal compression, gain a higher efficiency in db (sound pressure level), a stronger presence, and clearer audibility both for singing and speaking pieces.

I claim:

1. A device for omnidirectionally spreading sound waves and effecting separation thereof, comprising:

a sound source;

a housing having a first supporting wall for said sound source, said sound source being secured to said wall with its axis substantially orthogonal thereto;

a first reflector-diffractor disposed in the path of sound waves emitted by said sound source, said reflector-diffractor comprising:

(a) a sound reflective member having upper and lower surfaces and a zone transparent to sound waves, said transparent zone having a dimension corresponding to a predetermined wave length whereby said zone acts as a punctiform source of sound waves at or near said predetermined wave length for omnidirectionally spreading said waves, waves having longer wave lengths not transmitted through said zone being omnidirectionally spread by reflection between said lower surface of said reflector-diffractor and said wall; and (b) a first reflector disposed in the path of sound waves transmitted through said zone, said reflector comprising a sound reflective surface for omnidirectionally spreading said transmitted sound waves by reflection between said reflector and said upper surface of said reflector-diffractor.

2. The device according to claim 1, wherein said sound source comprises a tweeter; said transparent zone comprises an aperture in said sound reflective member substantially coaxial with said source; and said dimension comprises the diameter of said aperture.

3. The device according to claim 2, further comprising one or more additional reflector-diffractors disposed between said first reflector-diffractor and said first reflector, each additional reflector-diffractor comprising a sound reflective member having upper and lower surfaces, each of said one or more additional reflector-diffractors having an aperture therein substantially coaxial with said aperture in said first reflector-diffractor, the diameters of said apertures decreasing as the distance of the corresponding reflector-diffractor from said tweeter increases, each aperture diameter corresponding to a different predetermined wave length whereby each aperture acts as a punctiform source of sound waves at or near its corresponding wave length for omnidirectionally spreading said sound waves.

4. The device according to claim 3, wherein said reflector and said reflector-diffractors are substantially planar and arranged in substantially parallel relation.

5. The device according to claim 4, wherein said housing includes a second supporting wall substantially parallel to said first supporting wall; and further comprising a woofer secured to said second wall with its axis substantially orthogonal thereto, said woofer being oriented oppositely to said tweeter;

a second reflector having a first sound reflective surface disposed in substantially parallel confronting relation with said second supporting wall; and a pyramidal reflector disposed in confronting, substantially coaxial relation with said woofer, the base of said pyramidal reflector being secured to said second reflector, whereby sound waves from said woofer are omnidirectionally spread by reflection off said pyramidal reflector and reflection between said second wall and said second reflector.

6. The device according to claim 5, wherein said first and second reflectors, said reflector-diffractors, and said first and second walls comprise rectangular panels, the sides thereof being in the range from about 10 cm to about 100 cm, the thickness of said panels being in the range from about 1.5 mm to 15 mm, and wherein the diameters of the apertures in said reflector-diffractors are in the range from about 5 mm to about 125 mm.

7. The device according to claim 6, wherein said sides are in the range from about 14 cm to about 80 cm, said thickness is in the range from about 2 mm to about 9 mm, and said aperture diameters are in the range from about 10 mm to about 100 mm.

8. The device according to claim 6, wherein the distances between said panels and between said walls and said panels is in the range from about 90 mm to about 15 mm, said spacings decreasing as the distance from said housing increases.

9. The device according to claim 8, wherein the distances between said panels and between said walls and said panels are in the range from about 80 mm to about 20 mm.

10. The device according to claim 8, wherein said reflectors, said reflector-diffractors, and said walls are comprised of methacrylic homo-copolymers.

11. The device according to claim 6, and further comprising a midrange speaker secured to said first supporting wall with its axis substantially orthogonal thereto, said first reflector-diffractor and said one or more additional reflector-diffractors each including an additional aperture substantially coaxial with said midrange speaker, the diameters of said apertures decreasing as the distance of said reflector-diffractors from said midrange speaker increases, and wherein the axes of said tweeter and said midrange are substantially on a diagonal of said first supporting wall.

12. The device according to claim 11, wherein said second reflector is substantially planar, said first reflective surface thereof comprising one side of said reflector, and wherein the other side of said reflector is also sound reflective; and further comprising an additional housing having a wall in substantially parallel relation with said second reflector, a second woofer secured to said wall in confronting coaxial relation with said first woofer; and a second pyramidal reflector, the base thereof being secured to said other side of said second reflector in substantial coaxial relation with said second woofer.

13. The device according to claim 11, wherein said midrange is disposed behind said tweeter relative to a listener.

14. A method for omnidirectionally spreading sound waves from a sound source and for effecting separation thereof comprising:

passing said sound waves through a sound transparent zone having a dimension corresponding to a predetermined wave length of said sound waves for separating said sound waves into a first group having wavelengths longer than said predetermined wavelength and a second group having wave lengths shorter than said predetermined wavelength and wave lengths at or near said predetermined wavelength, said zone acting as a punctiform source of sound waves at or near said predetermined wavelength;

omnidirectionally reflecting said first group of sound waves by multiple reflections between confronting sound reflective surfaces defining a first open-sided cavity; and omnidirectionally reflecting said second group of sound waves by multiple reflections between confronting sound reflective surfaces defining a second open-sided cavity.

15. The method according to claim 14, wherein said zone comprises an aperture in a first sound reflective member, said dimension comprising the diameter of said aperture; and wherein said aperture is substantially coaxial with said sound source.

16. The method according to claim 15, wherein said step of omnidirectionally reflecting said first group of sound waves comprises placing said sound source between said first sound reflective member and a second sound reflective member with said sound source oriented towards said aperture, whereby the confronting surfaces of said first and second sound reflective members comprise said confronting surfaces of said first cavity; and wherein said step of omnidirectionally reflecting said second group of sound waves comprises placing a third sound reflective member in the path of sound waves passing through said aperture, whereby the confronting surfaces of said first and third sound reflective members comprise said confronting surfaces of said second cavity.

17. The method according to claim 16, wherein said first, second and third sound reflective members are substantially planar and arranged in substantially parallel relation.

18. The method according to claim 17, further comprising passing sound waves transmitted through said aperture in said first sound reflective member towards one or more additional coaxial apertures in one or more additional substantially planar sound reflective members disposed between said first and third sound reflective members and substantially parallel therewith, the spacing between successive reflective members and the diameters of their corresponding apertures decreasing as the distance of said reflective members from said sound source increases, whereby each additional aperture acts as a punctiform source of sound waves at or near another predetermined wavelength of said sound waves.

19. The method according to claim 18, wherein sound source comprises a tweeter.

20. The method according to claim 19, further comprising placing a second sound source between said first and second sound reflective members, said second sound source being oriented to propagate sound waves in the same direction as said first sound source; and providing an additional aperture in said first sound reflective member and in each of said one or more additional sound reflective members with each additional aperture being substantially coaxial with the axis of said additional sound source and having a diameter corresponding to a different predetermined wavelength, the diameters of said apertures decreasing as the spacing of its corresponding reflective member from said additional sound source increases.

21. The method according to claim 20, wherein said additional sound source comprises a midrange.

22. The method according to claim 21, further comprising orienting a third sound source to propagate sound waves in a direction opposite to said first and second sound sources; and placing a pyramidal reflector coaxial with said third sound source with the apex of said pyramidal reflector confronting said third sound source.

23. The method according to claim 22, wherein said third sound source comprises a woofer.

24. The method according to claim 23, wherein said tweeter and midrange are disposed in one wall of a housing, said wall comprising said second sound reflective member, and said woofer is disposed in a parallel wall on the opposite side of said housing.

25. The method according to claim 24, wherein said housing, said reflective members and said pyramidal reflector comprise acrylic polymers.

26. The method according to claim 25, wherein said housing, said reflective members and said pyramidal reflector comprise methacrylic homo-copolymers.

* * * * *